US005743131A

United States Patent [19]

Holliday et al.

[11] Patent Number: 5,743,131

[45] Date of Patent: Apr. 28, 1998

[54] RATCHETED CRIMPING TOOL

[75] Inventors: Randall A. Holliday, Westminster; Ricky A. Yates, Denver, both of Colo.

[73] Assignee: ICM Corporation, Denver, Colo.

[21] Appl. No.: 742,503

[22] Filed: Nov. 1, 1996

[51] Int. Cl.[6] ..... B21D 39/04

[52] U.S. Cl. ..... 72/409.1; 72/409.13; 72/409.19; 81/313; 29/237

[58] Field of Search ..... 72/409.19, 409.14, 72/409.13, 409.12, 409.01, 416, 409.1; 81/313; 29/237, 281.4

[56] References Cited

U.S. PATENT DOCUMENTS

| | | | |
|---|---|---|---|
| 276,291 | 4/1883 | Sellers | 72/416 |
| 326,897 | 9/1885 | Brooks | 81/313 |
| 3,837,211 | 9/1974 | Gress | 72/409.01 |
| 3,972,112 | 8/1976 | O'Sickey | 29/237 |
| 4,985,975 | 1/1991 | Austin | 29/237 |
| 5,121,624 | 6/1992 | Haughian | 72/416 |
| 5,297,325 | 3/1994 | Thelen | 29/237 |
| 5,392,508 | 2/1995 | Holliday et al. | 29/751 |

FOREIGN PATENT DOCUMENTS

| | | | |
|---|---|---|---|
| 1033112 | 6/1966 | United Kingdom | 72/409.12 |

*Primary Examiner*—Daniel C. Crane
*Attorney, Agent, or Firm*—John E. Reilly

[57] ABSTRACT

There is disclosed a tool for connecting a cable fitting to the end of a coaxial cable. The tool is made up of one or more dies with a cavity therein, a carrier chuck which is axially spaced from the die surfaces to support the fitting in relation to the end of the cable, and a handle pivotally mounted to cause axial movement of the carrier chuck. The carrier chuck is pushed toward the die surfaces to axially force the fitting into the die cavity to reduce the circumference of one end of the fitting into a generally conical configuration securely engaging the cable. A radial ratchet mechanism on the handle prevents the carrier chuck from moving away from the die until the fitting has been fully and properly secured to the cable. The dies are specially shaped to have a guiding portion which smoothly and consistently guides the fitting into proper relation to the dies, and a stop limiting portion to prevent the fitting from being forced too far into the die. An O-ring upon the carrier chuck assists in maintaining the proper position of the fitting upon the carrier chuck.

17 Claims, 1 Drawing Sheet

RATCHETED CRIMPING TOOL

BACKGROUND AND FIELD OF INVENTION

This invention relates to crimping devices and more particularly relates to a novel and improved crimping tool for compressing fittings into uniform sealed engagement with cables, such as coaxial cables used in the television industry.

It is common in the consumer electronics industry, especially the cable television industry, to employ a hand-held crimping tool to attach the standard fitting onto the end of a coaxial cable. The fitting can then be threadedly connected into the mated fitting or terminal on the television set. Presently, many crimping tools are designed to crimp or reduce the size of the connector sleeve on the cable side of the fitting into a generally hexagonal or six-sided configuration in attaching the fitting to the end of the cable. These tools function similarly to pliers, where the hexagonal crimping generally is accomplished by applying a crimping force directly radially onto the fitting sleeve. A major problem with the hexagonal crimp, however, is that it does not completely seal off the end of the cable and permits air and moisture to enter by way of the cable end which can affect the quality of the picture and gradually erode the cable itself.

U.S. Pat. No. 5,392,508 to Holliday, et. al. overcame many of the shortcomings of hexagonal crimping devices by providing a crimping tool which achieves the desired reduction in diameter or size of the cable end of the fitting into a rounded or generally circular configuration by applying an axially directed force to the fitting, as opposed to direct radial compression. U.S. Pat. No. 5,392,508, the teachings of which are hereby incorporated by reference, supplies background to the present invention, and reference to that patent aids a thorough understanding of the present invention.

We have determined, however, that it is desirable that the crimping tool not be inadvertently released from the cable prior to achieving the desired crimped connection between the fitting and the cable. The features of the present invention may be incorporated into an axial deformation crimping tool of the type disclosed in U.S. Pat. No. 5,392,508 to Holliday, et. al., but is adaptable to other applications as well. The present invention meets a previously unmet need for a tool that cannot be mistakenly disengaged from the cable until crimping is completed and minimizes possible injury to the operator during the crimping operation.

Moreover, it is sometimes difficult to maintain a fitting properly positioned within known axial deformation crimping tools. During operation of known devices, the fitting occasionally becomes dislodged, tilted, or askew with respect to the crimping dies. If the fitting is improperly positioned during operation of the tool, the crimping action is defective, resulting in an unsatisfactory connection of fitting to cable, or no connection at all.

Thus, a need remains for an axial deformation crimping tool which incorporates elements and components which safeguard against premature disengagement of the tool from the cable. A further need remains for a crimping tool which maintains the fitting in the proper position during operation, which smoothly and reliably guides the fitting into proper alignment with and insertion into the crimping die, and avoids any tendency of the handle to snap back or be disengaged prior to completion of the crimping operation.

SUMMARY OF INVENTION

It is an object of the present invention to provide for a novel and improved hand-held portable crimping tool for crimping hollow cylindrical sleeve portions of a fitting into sealed engagement with the end of a cable.

It is an additional object of the present invention to provide a crimping tool that may not easily be prematurely disengaged from the cable prior to obtaining a fully sealed connection between the cable and the fitting.

It is a further object of the present invention to provide an axial deformation crimping tool which maintains the fitting in proper position during operation.

It is a further object of the present invention to provide an axial deformation crimping tool incorporating a crimping die shaped to promote consistent, uniform, and proper positioning of the fitting with respect to the die prior to crimping.

In accordance with the present invention, a novel and improved crimping apparatus has been devised for connecting a cable fitting having a generally tubular connector sleeve to an end of a cable wherein the sleeve is composed of a thin-walled deformable material. The apparatus includes a die member defining a tapered cavity therein, carrier means axially spaced from the cavity for supporting the sleeve in facing relation to a first end of the cavity when the cable end extends through the cavity and at least partially into the sleeve, support means for mounting the carrier means for reciprocal axial movement between a retracted position and an extended position toward the die whereby to force the sleeve axially into the cavity under sufficient force to radially contract the sleeve into a tapered configuration corresponding to that of the cavity, and means for preventing the carrier means from moving toward the retracted position until the carrier means is first in the extended position.

In a preferred form of invention, the crimping device takes the form of a hand-held crimping tool having pivotal lever handles at one end which can be manually grasped to exert the necessary axial force on the carrier means to force the fitting sleeve axially into engagement with the die whereby to uniformly reduce the circumference of the sleeve into a generally conical configuration snugly engaging the end of the cable. Each die is preferably comprised of split die portions, one of the portions being controlled by a toggle arm to pivot into and out of circumferential alignment with the other of the die portions to permit extension of the cable through the cavity and the other die portion being adjustably mounted to establish proper alignment and sizing of the cavity for proper crimping of the connector sleeve into the desired size.

A preferred embodiment further includes a pawl or detent and a ratchet which control the pivotal movement of a handle, so that the carrier means automatically is prohibited from being prematurely withdrawn away from the die prior to the connector sleeve being fully and reliably crimped against the cable.

Also in accordance with the present invention, the die defines a segmented cavity with an inner surface, an intermediate chamfered surface, and an additional wide angle, tapered outer surface which guides the connector consistently and uniformly into position with the die.

Also in accordance with the present invention, the carrier means includes a portion mounting means for inducing frictional engagement between the carrier means and the fitting whereby the fitting is releasably but firmly held in position when the carrier means is moved toward the extended position. A preferred embodiment provides an O-ring as a means for inducing friction between the carrier means and the fitting.

The above and other objects, advantages and features of the present invention will become ore readily appreciated and understood from a consideration of the following detailed description of preferred and modified forms of the present invention when taken together with the accompanying drawings in which:

DETAILED DESCRIPTION OF THE PREFERRED EMBODIMENT

Figure 1:
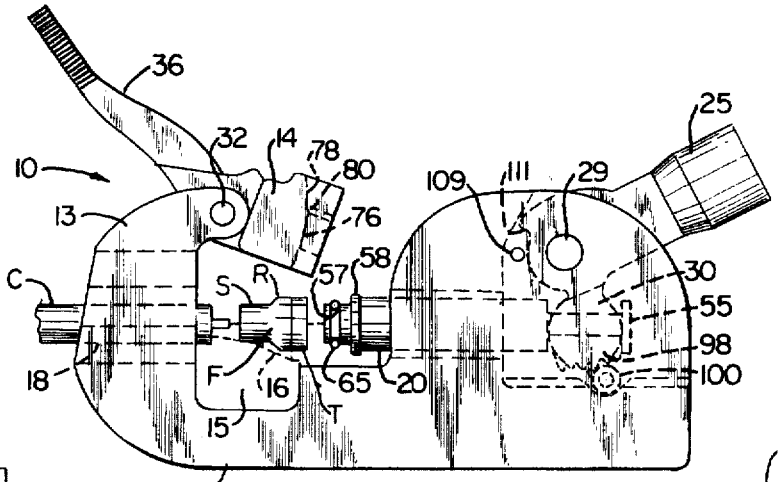
FIG. 1 is a side view of the preferred embodiment of the invention.

Referring in detail to the drawings, there is illustrated a preferred embodiment of crimping tool 10. As best seen from FIG. 1, the crimping tool 10 is specifically adaptable for use in connecting a standard fitting F to one end of a conventional coaxial cable C so that the cable C may then be attached to the terminal or post on a television set. Typically, the fitting F is made up of a threaded end portion T to be connected to a terminal or post, and a hollow cylindrical connector sleeve S to be attached to the end of the cable C with a conductive element from the cable projecting beyond the threaded end T. Sleeve S is rotatably connected to end portion T by a cylindrical housing having a diameter larger than the diameter of the sleeve, thereby defining an exterior ridge or shoulder R upon the fitting. Again, the use of the crimping tool 10 in affixing a fitting F to the end of the coaxial cable C is given more by way of illustrative example and it will become apparent hereinafter that the tool is readily conformable for use as a force applying member in compressing or crimping other fittings or connectors.

The preferred form of crimping tool 10 is broadly comprised of a common base or body portion 12 having a die support end 13 to receive split die portions 14 and 15 which define a common tapered cavity 16 therebetween and in communication with a larger cavity opening 18 which is formed in the end of the body 12. A carrier 20 is in the form of a generally cylindrical chuck which is slidably disposed within support block 24 at one end of the base 12 axially spaced from the die portions 14 and 15. The carrier 20 is so positioned as to be axially spaced from but in alignment with the axis of the cavity 16. A handle 25 extends away from the one end of the body 12, the handle 25 being pivotally attached by pivot pin 29 to an upper portion of the support block 24. A cam portion 30 on the end of the handle 25 is engageable with the carrier 20 to cause the carrier to be forced in an axial direction between the retracted position shown by solid lines in FIG. 2 and the extended position shown by phantom lines in that figure. Preferably the die support end 13 and axially spaced chuck support end 24 are of unitary construction with the common base 12.

Figure 4:
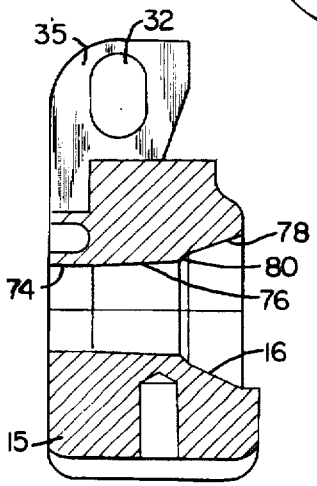
FIG. 4 is an enlarged side sectional view of a portion of the FIG. 1 embodiment, showing a specifically configured die assembly.

In order to permit extension of the fitting F and cable C into position between the die support end 13 and the support block 24, the upper die portion 14 is pivotally mounted by pivot pin 32 for vertical movement of the die portion 14 through a slot in the support portion 13 between a closed position as illustrated in FIG. 4 and an open position as illustrated in FIG. 1. The die portion 14 has an offset portion 35 to receive the pin 32, a laterally directed finger-engaging portion 36 and a generally conical end portion 38 which in the closed position defines an upper half of the common cavity 16, as illustrated in FIGS. 1 and 4. The lower die portion 15 is similarly in the form of a generally rectangular block which is disposed in the base 12. The lower portion of the upper die 14 defines at least two generally semi-conic surfaces which taper rearwardly along predetermined angles to define a crimping surface 76 and an outer surface 78. The upper portion of the lower die 15 defines surfaces corresponding to the surfaces 76, 78 defined by the upper die 14, so as to form with the upper die 14 the tapered cavity 16 in communication with the opening 18. The opening 18 may be slightly enlarged in relation to the cavity 16.

FIGS. 1 and 4 show a die assembly which reliably, consistently, and uniformly aligns the connector sleeve S with the die portions 14, 15 prior to the complete insertion of the sleeve. As mentioned, the upper die portion 14, defines at least two topologically distinct surfaces, an outer surface 78, and a crimping surface 76. Lower die 15 defines corresponding opposing surfaces thereon, so that the common cavity 16 between the two die surfaces manifests an axially symmetric, generally funnel-like shape with two segmented regions of decreasing circumference and diameters progressively decreasing in the direction of the support end 13. As FIG. 4 illustrates, the rate at which the diameters decrease—the degree of taper—is distinct for each of the two surfaces 76 and 78 which define the cavity 16.

Referring to FIG. 4, the diameters defining the outer surface 78 of cavity 16 decrease from a mostly arbitrary largest diameter to an intermediate diameter slightly larger than the outside diameter of the sleeve S on the fitting F (FIG. 1). The largest diameter, at the axial end of the cavity 16 closest to the carrier 20, is substantially greater than the outside diameter of the exterior ridge or shoulder R on the fitting F. The diameters defining intermediate crimping surface 76 of the cavity 16 in turn decrease from a diameter approximately equal to the outside diameter of the sleeve S, down to a diameter corresponding generally to the outside diameter of the cable C. The diameter defining an optional inner surface 74 substantially corresponds to the outside diameter of cable C. The inner surface 74 is in communication with the larger cavity opening 18.

Preferably, there is provided at the intersection of the two surfaces 76, 78 a small chamfer 80 defining the transition between the outer surface 78 and the crimping surface 76. The chamfer 80 has a relatively abbreviated axial dimension and a steeper taper than either the outer surface 78 or the intermediate surface 76, and thereby defines a discrete stop or limiting surface against which the exterior ridge R may contact at the completion of the crimping process. Alternatively, the diameter of the cavity 16 abruptly changes at the location along the cavity's axial length corresponding to the intersection of the outer surface 78 with the crimping surface 76 and wherein the intersection defines an annular point of constriction too small in diameter to permit the exterior ridge R of the fitting to enter therein.

When the die members 14, 15, are in a closed relationship, the crimping surface 76 of upper die 14, and the corresponding crimping surface 76 of lower die 15, are tapered at complementary angles so as to form a uniform reduction in diameter from the chamfer 80, adjacent the enlarged outer portion of cavity 16 which in turn faces the carrier 20, directed toward opening 18. The degree of taper of the crimping surfaces 76 is such that the crimping portion of the cavity will cause the connector sleeve S on the fitting F to sealingly engage the outer surface of the cable C when the fitting F is pushed through the die assembly by the carrier 20.

Referring to FIG. 4, the outer surfaces 78 of the cavity 16 serve to coaxially align and position the sleeve S as it enters the dies 14, 15. As the sleeve S moves toward and into the dies 14, 15, it may contact and slide past the outside surfaces 78 of the dies until it is coaxially aligned with the portion of the cavity 16 defined by the crimping surfaces 76. However, once the exterior ridge or shoulder R of the fitting F has moved past the outer portion of cavity 16 between outer surfaces 78, it bears against the chamfered surface 80 at the intersection between outer surfaces 78 and crimping surfaces 76 and can move no farther between the dies 14, 15, thereby acting as a limit stop for the sleeve S. At this point, the leading end of the sleeve S will be proximate to the inner end of the crimping portion of the cavity 16, and will have contracted into firm engagement with the end of the cable C. The leading end of the sleeve S is prevented from entering the opening 18 by the narrow diameter defined by the inner surface 74 as well as the ridge R bearing against the surface 80.

In the preferred embodiment, the outer surfaces 78 of the cavity 16 serve as a guide, automatically and consistently aligning the fitting F with respect to the dies 14, 15 prior to the sleeve S being crimped by its contact with the crimping surfaces 76. Also, the exterior shoulder R of the fitting F is prevented from being inadvertently overextended into the crimping portion of the dies. The invention thus promotes a more reliable engagement of the fitting F with the cable C by reducing the number of instances where the fitting F is askew or cocked with respect to the axis of the cavity 16 defined by the crimping surfaces 76 of the dies 14, 15.

Figure 2:
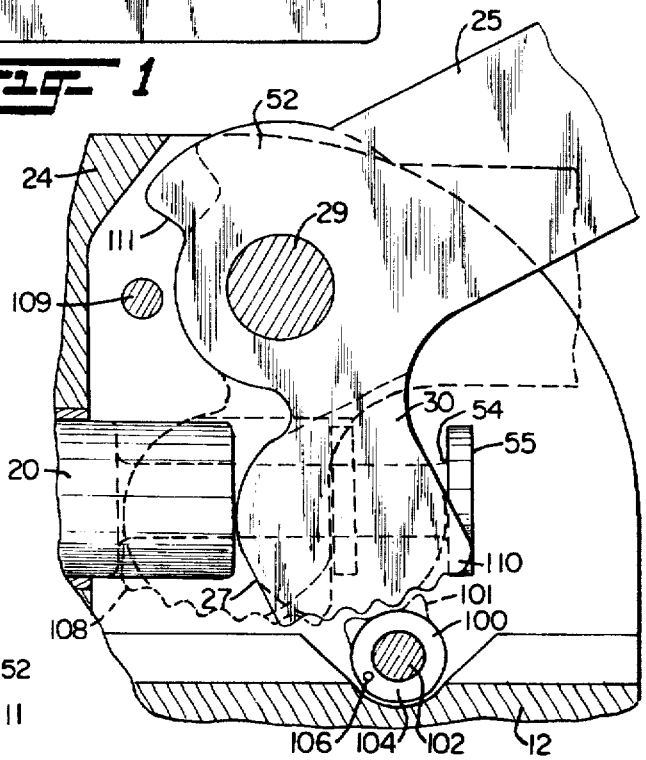
FIG. 2 is an enlarged side view, in partial section, of a portion of the embodiment shown in FIG. 1.
Figure 3:
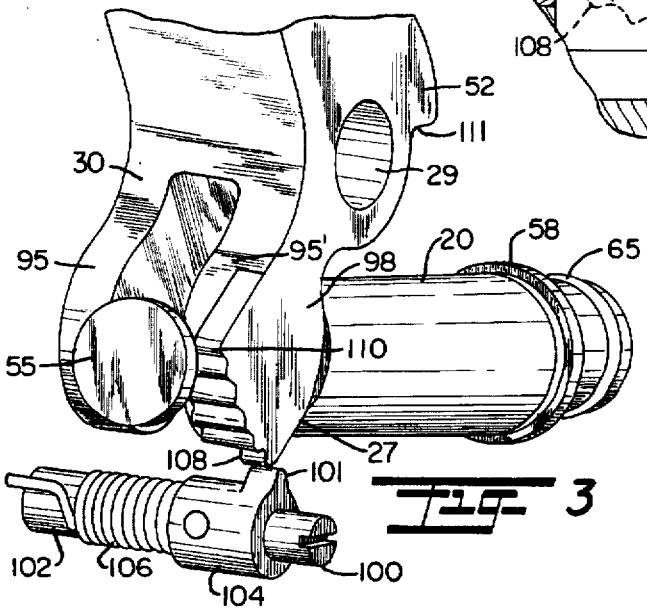
FIG. 3 is a perspective view of the portion of the invention shown in of FIG. 2.

The support block 24 defines an upright extension of the base 12 at the one end opposite to the die support end 13 and is provided with an upper, open vertical slot for insertion of pivotal end 52 of the handle 25. The cam member 30 defines a lateral projection away from the pivotal end 52. The cam 30 is of generally rounded configuration and further is bifurcated or slotted, as illustrated in FIGS. 2 and 3, to fit over the rod 54 at the trailing end of the carrier 20. The cam member 30 is interpositioned between the elongated cylindrical carrier body 20 and an enlarged end 55. The opposite end of the carrier 20 has a shoulder 58 which serves as an end stop to limit the depth of insertion of the end of the carrier 20 into the threaded end T of the fitting F to be crimped.

Preferably, a lower handle member (not shown) is in the form of an elongated rod having a gripping surface, the lower handle extending horizontally from a threaded connection to the end of the base 12. The base 12 has a flat bottom surface so that the tool can be placed on a table or other surface in an upright position as shown. In crimping, a fitting F is assembled onto the end of a cable C, and the pivotal die portion 14 is lifted as illustrated in FIG. 1 so that the assembled fitting F and cable C can be inserted from the end of the die support portion 13 through the opening 18 and the threaded end T of the fitting F advanced over the end of the carrier 20 into engagement with the shoulder 58. The die portion 14 is then pivoted downwardly into the closed position as shown in FIG. 4 in alignment with the lower die 15 and in surrounding relation to the cable C. In this relationship, the interior crimping surfaces 76 surfaces of the respective dies are tapered at corresponding angles so as to form a uniform reduction in diameter from the larger end of the crimping portion of the cavity 16, which faces the carrier 20, to the reduced end of the crimping portion nearest to the opening 18, the degree of taper being selected such that the inner end of the crimping surface 76 will cause the connector sleeve S on the fitting F to sealingly engage the outer surface of the cable C.

The upper handle 25 extends at a relatively low gradual angle away from the support block 24. Once the fitting F has been assembled as described onto the carrier 20, the handle 25 is manually grasped and forced downwardly causing the cam member 30 to drive the carrier 20 forwardly in an axial direction until the connector sleeve S enters the cavity 16. Thus, the pivotal action of the upper handle 25 as it is forced downwardly is converted into an axial force along the axis of the carrier 20 and which will cause the leading end of the sleeve S to gradually contract into a tapered configuration corresponding to that of the crimping surfaces 76 as it is axially advanced through the cavity 16.

When the leading end of the sleeve reaches the reduced end of the crimping portion of cavity 16, it will have contracted into firm engagement with the cable end C while retaining its circular configuration, thereby effecting uniform sealed engagement with the cable which will prevent the entry of air or moisture between the fitting and cable when in use. By the application of an axial force as described, it is possible to advance the sleeve S into a stationary die member and, as a result, the die cavity can be formed to extremely close tolerances and be rigidly anchored as described during the crimping operation.

Cable fittings F of the type described are customarily made of brass. Although the fitting F as illustrated has a sleeve with a smooth external surface, the tool 10 of the present invention is equally useful with connector sleeves S having spaced circumferentially extending ribs on their external surfaces.

FIGS. 1 and 3 illustrate that the end of the carrier 20 may be provided with a groove 57 circumferentially about its narrow portion in the vicinity of shoulder 58. Groove 57 is to seat or receive an O-ring 65 therein. O-ring 65-provides frictional engagement between the carrier 20 and the fitting F. This frictional engagement more reliably holds the fitting F in proper position upon carrier during the movement of the carrier 20 toward the dies 14, 15. O-ring 65 frictionally engages the inside wall of the fitting F when the shoulder 58 contacts the fitting. The fitting F is thus less prone to tilt, tip or fall with respect to the carrier while the carrier 20 is moving; yet the fitting F is easily deliberately released from the carrier 20. The frictional contact between the O-ring 65 and the inside of the fitting is nearly effortlessly broken by pulling the cable C axially away from the carrier 20 after crimping is completed.

It will be evident from the foregoing that the degree of axial force may be varied by modifying the length of the handle 25 and altering the distance between the cam 30 and pivot pin 29. Furthermore, while the tool has been described as being placed on a stationary surface with the lower handle resting on the surface, it is readily conformable for use by grasping two handles in one or both hands and applying the necessary pressure to crimp the sleeve and, in this regard, is sufficiently small or compact and lightweight that it can be carried on one's person when not in use.

In the preferred embodiment, a ratchet mechanism has been added to promote proper use of the apparatus. As mentioned, pivotal end 52 of handle 25 is attached pivotably to the support block 24 by pin 29, while cam member 30 is securely attached to or forms an integral part of the pivot end 52 of handle 25. Cam 30 is disposed closer to the pin 29, and the pin 29 is comparatively lower in support block 24, than in known axial deformation crimping tools, thus shortening the throw or moment arm between the pin 29 and the axis of the carrier 20. Accordingly, the amount of axially directed force applied to the carrier 20 is greater, for a given amount of radial movement of the handle 25, than provided by known devices.

As mentioned, cam 30 is bifurcated, having a pair of parallel spaced apart legs 95, 95', each with a cam surface 27. The cylindrical carrier 20 is slidably disposed horizontally through the void between legs 95, 95', so that each cam surface 27 contacts carrier 20. Thus, with the downward pivotal movement of handle 25, the sliding engagement of the cam surface 27 on each of legs 95, 95' against the carrier 20 allows radial motion of the legs 95, 95' to urge the carrier 20 from the retracted position shown in solid lines in FIG. 2 to the extended position shown in phantom lines. The power of the lever action of the descending handle 25 is efficiently converted, via the highly leveraged cam action of the cam surface 27 against the carrier 20, into a short but powerful translation of the carrier 20 axially toward the dies 14, 15. Notably, when handle 25 is pivotally raised the cam surfaces similarly push against the enlarged end 55 of carrier 20, thereby urging the carrier 20 to withdraw toward the retracted portion shown in solid lines in FIG. 2.

Expressed upon and preferably integral with one of legs 95, 95' is a radial ratchet 98 with a plurality of teeth engageable with the tooth 101 of roller detent 100. The operative engagement of the radial ratchet 98 with the roller detent 100 functions to assure that the operator does not inadvertently retract the carrier 20 before it has attained the maximally extended position necessary to force the leading end of the sleeve fully into the portion of cavity 16 defined by crimping surface 76.

Detent 100 is suitably mounted within common base 12 so as to be rotatable about its own axis as shown in FIGS. 2 and 3. Detent 100 may consist of a central shaft 102 upon which a collar 104 is concentrically and fixably attached. Tooth 101 is directed generally upward from collar 104 toward the radial ratchet 98, as shown in FIG. 2. The detent 101 is spring-loaded by a helical spring 106 disposed around the shaft 102 and engaged with the common base 12. The spring 106 biases the shaft 102 to rotate so as to radially move the tooth 101 away from the support block 24 (i.e., clockwise in FIG. 2). Tooth 101 is functionally engageable with each of the teeth in radial ratchet 98.

FIGS. 1–3 illustrate the cooperative disposition and relationship between the radial ratchet 98 and the roller detent 100 when the pivotal handle 25 is pivoted downward. The process of placing the fitting F upon the end of cable C and passing it through the aligned cavities between the die members 14, 15, and advancing the fitting F until it is engaged with the shoulder 58 at the leading end of carrier 20, is substantially the same as previously described. The use of the embodiment of FIG. 3, employing an O-ring 65 to engage carrier 20 with fitting F, is recommended but not essential.

Initially, the carrier 20 is in its retracted position as shown in solid lines in FIG. 2. Tooth 101 of roller detent 100 initially is directed away from support 24 due to the action of spring 106, in contact with the initial tooth 108 on radial ratchet 98, as shown in phantom in FIG. 2.

As handle 25 is pivoted from the position shown in solid lines in FIG. 2 toward that shown by phantom lines in the same figure, engagement of the cam surface 27 against the carrier 20 forces the carrier 20 toward the dies 14 and 15. Concurrently, tooth 101 on the roller detent 100 is rotated forwardly (counter clockwise in FIG. 2), by its engagement between teeth on the pivoting radial ratchet 98, to the position shown by solid lines in FIG. 2. Thus the radial ratchet 98 is advanced toward support 24 by rotation of the handle 25 about pivot pin 29, and the carrier 20 is advanced forwardly toward the extended position. The carrier 20 is maintained in incrementally progressive forward positions by the serial engagement of the tooth 101 with successive teeth on the radial ratchet 98.

As the handle 25 is pressed downwardly, the radial ratchet 98 moves past the fixed roller detent 100, causing tooth 101 of the roller detent 100 to pivot slightly to allow it to pass over successive teeth on radial ratchet 98. Besides minor pivoting action against the bias of spring 106 as it passes over each tooth, however, the detent tooth 101 remains in substantially constant contact with radial ratchet 98 and generally in the position shown in solid lines on FIGS. 1 and 2. Locking engagement of tooth 101 in the gaps between adjacent teeth on ratchet 98 acts to prevent backward (counter-clockwise in FIG. 2) rotation of handle 25 around pivot 29, thus barring accidental rearward movement of the carrier 20 toward the retracted position. Roller detent 100 thus interacts with radial ratchet 98 to prevent the carrier 20 from prematurely back-sliding away from any intermediate position toward the dies 14, 15 during the downward pivotal movement of the handle 25.

When cam 30 has urged the carrier 20 into its maximally extended position as shown in phantom in FIG. 2, the crimping process is complete. Substantially concurrently with the completion of crimping, when the carrier is maximally extended, tooth 101 on roller detent 100 slips over and past final tooth 110 on radial ratchet 98. When the tooth 101 has passed the final tooth 110 on the ratchet 98, the spring 106 rotates the collar 104 clockwise to restore tooth 101 to its position depicted in phantom in FIG. 2. The tooth 101 then is substantially disengaged from the teeth of the radial ratchet 98, thereby freeing the handle 25 to be raised once again in preparation for a second crimping cycle.

As the handle 25 is raised, the detent tooth 101 simply rides over the passing teeth on the ratchet 98 with the clicking or buzzing sound often associated with the return stroke of ratchet devices. A stop 109 fixably mounted within the support frame 24 is engageable against a catch 111 upon the pivot end 52 of handle 25 to prevent over-rotation of the handle 25 in the counter-clockwise direction in FIGS. 1 and 2. When the handle 25 is fully raised, it is poised for the initiation of a new crimping stroke, and the described crimping process may be repeated.

Among other advantages of this invention is to promote the safe and reliable use of the tool. The ratchet mechanism prevents the carrier 20 from being withdrawn from the dies 14, 15 before the full crimping stroke has been completed. Not until the sleeve S has been fully compressed onto the cable C does the tooth 101 on the detent 100 swing out of locked engagement with the teeth of the ratchet 98. The carrier 20 does not pop back out of the support 24 until the crimping has been accomplished, and then only when the user raises the handle 25. In the event the fitting F is misfit into the dies 14, 15, or in the event of a jam in the apparatus or some other mishap during the crimping stroke but prior to completion, the detent 100 may be pushed laterally with a screwdriver deliberately to prematurely disengage the ratchet mechanism. Alternative releases may also be provided, such as shown in FIG. 3, a slotted end on the detent shaft which can be rotated by a screwdriver to advance the tooth 101 forwardly to release it from the ratchet and permit immediate release of the handle 25.

It is therefore to be understood that while a preferred embodiment of the present invention is herein described and illustrated, variations and modifications of the invention will occur to persons of ordinary skill in the art, and it is intended to cover in the appended claims all such modifications and reasonable equivalents thereof.

We claim:

1. In a crimping apparatus for connecting a cable fitting to an end of a cable, said fitting having an external shoulder and a generally tubular connector sleeve composed of a thin-walled deformable material, and said apparatus having a die member defining an outer diameter exceeding an outer diameter of said sleeve, an outer diameter of said sleeve exceeding the outer diameter of the end of the cable, the improvement comprising:

said die member comprising segmental tapered surfaces defining circumferential portions of a tapered cavity, said segmental tapered surfaces comprising:

an outer surface, defined in part by a first diameter at a first end of said cavity and in part by an intermediate diameter axially spaced from said first diameter, said first diameter substantially greater than an outside diameter of the external shoulder, and said intermediate diameter substantially corresponding to the outer diameter of the sleeve;

a crimping surface defined in part by said intermediate diameter and in part by a third diameter, said third diameter axially spaced from said intermediate diameter and substantially corresponding to the outer diameter of the cable;

limit stop means disposed between said outer and crimping surfaces engageable with said external shoulder for limiting axial movement of the sleeve into said die member;

carrier means axially spaced from said cavity for supporting the sleeve in facing relation to said first end of said cavity with the end of the cable extending through said cavity and at least partially inserted into the sleeve; and support means mounting said carrier for axial movement toward and away from said die member whereby to force the sleeve axially against said crimping surface under sufficient force to radially contract the sleeve into a tapered configuration to thereby connect the sleeve to the end of the cable.

2. In a crimping apparatus according to claim 1, wherein said limit stop means is defined by an annular chamfered surface in said cavity, and wherein said shoulder is contactable against said chamfered surface.

3. In a crimping apparatus according to claim 2, wherein said carrier means is movable axially between a position retracted away from said die member and a position maximally extended toward said die member whereby to force the sleeve axially into said cavity, and further comprising control means for preventing said carrier means from moving axially toward said retracted position until said carrier means is in said extended position.

4. In a crimping apparatus according to claim 3 further comprising force-applying means on said support means for applying an axial force to said carrier means thereby to urge said carrier means toward said extended position.

5. In a crimping apparatus according to claim 4 wherein said force-applying means comprises a handle pivotable in one direction to urge the carrier means toward said retracted position, and in another direction to urge the carrier means toward the extended position.

6. In a crimping apparatus according to claim 5, wherein said control means comprises a detent engageable with a toothed ratchet to prevent movement of said carrier away from said die until said carrier means has reached said extended position.

7. In a crimping apparatus according to claim 6, wherein said detent engages said toothed ratchet when said handle is moving from said retracted position toward said extended position, thereby preventing said handle from pivoting in said one direction.

8. In a crimping apparatus according to claim 7, further comprising spring means for biasing said detent in a direction to disengage from said ratchet when said carrier means is in said extended position.

9. In a crimping apparatus according to claim 3, further comprising means for inducing frictional engagement between said carrier means and the fitting thereby to releasably hold the fitting upon said carrier means.

10. A crimping apparatus according to claim 9 wherein said means for inducing friction comprises a resilient O-ring disposed upon said carrier.

11. A crimping apparatus for connecting a cable fitting having an external shoulder and a generally tubular connector sleeve to an end of a cable wherein said sleeve is composed of a thin-walled deformable material, said apparatus comprising:

a die member defining a tapered cavity therein, said cavity comprising an outer surface of a diameter greater than an outside diameter of said external shoulder, a tapered crimping surface defined in part by an intermediate diameter substantially corresponding to the outer diameter of the sleeve and tapering into a smaller diameter axially spaced from said intermediate diameter and substantially corresponding to the outer diameter of the cable, and means disposed between said outer and crimping surfaces engageable with said external shoulder for limiting axial movement of the sleeve into said die member;

carrier means axially spaced from said cavity including means for releasably supporting the fitting with the sleeve in facing relation to said cavity and the cable end extending through said cavity and at least partially into said sleeve; and support means mounting said carrier means for reciprocal axial movement between a position retracted away from said die member and a position maximally extended toward said die member whereby to force the sleeve axially into said tapered cavity under sufficient force to radially contract the sleeve into a tapered configuration conforming with said crimping surface to thereby connect the sleeve to the end of cable.

12. A crimping device according to claim 11 wherein said means for inducing friction comprises a resilient O-ring disposed upon said carrier.

13. In a crimping apparatus for connecting a cable fitting having a generally tubular connecting sleeve to an end of a cable wherein said sleeve is composed of a thin-walled deformable material and a die member defining a tapered cavity therein is provided with a first end and carrier means is axially spaced from said cavity for supporting the sleeve in facing relation to said first end of said cavity with the end of the cable extending through said cavity and at least partially into the sleeve, the improvement comprising:

support means for mounting said carrier means for reciprocal axial movement between a position retracted away from said die member and a position maximally extended toward said die member;

force-applying means including a pivotal handle provided with a cam member at a pivotal end thereof slidably engageable with an end of said carrier means for forcing the sleeve axially into said tapered cavity under sufficient force to radially contract the sleeve into a tapered configuration conforming with said tapered cavity whereby to connect the sleeve to the end of the cable; and control means for preventing said carrier means from moving axially toward said retracted position until said carrier means is in said extended position including a toothed ratchet on one edge of said cam member opposite to said pivotal end of said handle, and a detent engageable with said ratchet when said carrier is moving from said retracted position toward said extended position thereby preventing said handle from pivoting in said one direction.

14. In a crimping apparatus according to claim 13, further comprising spring means for biasing said detent, and wherein said detent is biased to disengage from said ratchet when said carrier means is in said extended position.

15. In a crimping apparatus according to claim 13, further comprising means for inducing frictional engagement between said carrier means and the fitting thereby to hold the fitting on said carrier means.

16. In a crimping apparatus according to claim 15 wherein said means for inducing friction comprises a resilient O-ring disposed upon said carrier.

17. In crimping apparatus according to claim 14, said detent including manual release means for disengaging said detent from said ratchet prior to completion of the axial movement of said carrier means to said extended position.

* * * * *